United States Patent [19]

Dorn et al.

[11] Patent Number: 4,890,754

[45] Date of Patent: Jan. 2, 1990

[54] PILFER-RESISTANT PLASTIC CLOSURE

[75] Inventors: Henry J. Dorn, Frackville; Bruno Zumbuhl, Conyngham, both of Pa.

[73] Assignee: Zapata, Industries, Inc., Frackville, Pa.

[21] Appl. No.: 357,716

[22] Filed: May 26, 1989

[51] Int. Cl.[4] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 3,555,606 | 1/1971 | Hedgewick | 18/2 |
| 3,929,246 | 12/1975 | Leitz | 215/252 |
| 3,940,103 | 2/1976 | Hilaire | 249/68 |
| 4,147,268 | 4/1979 | Patel et al. | 215/252 |
| 4,155,698 | 5/1979 | Aichinger | 425/556 |
| 4,345,692 | 8/1982 | Obrist et al. | 215/252 |
| 4,407,422 | 10/1983 | Wilde et al. | 215/246 |
| 4,418,828 | 12/1983 | Wilde et al. | 215/252 |
| 4,432,461 | 2/1984 | Mumford et al. | 215/252 |
| 4,496,302 | 1/1985 | Brown | 425/547 |
| 4,497,765 | 2/1985 | Wilde et al. | 264/268 |
| 4,501,373 | 2/1985 | Heinlein | 215/252 |
| 4,503,985 | 3/1985 | Swartzbäugh et al. | 215/252 |
| 4,506,795 | 3/1985 | Herr | 215/252 |
| 4,511,053 | 4/1985 | Brandes et al. | 215/252 |
| 4,511,054 | 4/1985 | Shank | 215/252 |
| 4,526,282 | 7/1985 | Dutt et al. | 215/252 |
| 4,527,704 | 7/1985 | Swartzbaugh | 215/252 |
| 4,545,496 | 10/1985 | Wilde et al. | 215/252 |
| 4,552,328 | 11/1985 | Dutt et al. | 249/67 |
| 4,579,241 | 4/1986 | Hayes | 215/252 |
| 4,595,110 | 6/1986 | Herr | 215/252 |
| 4,667,838 | 5/1987 | Yeager | 215/252 |

FOREIGN PATENT DOCUMENTS

| | | |
|---|---|---|
| 1296166 | 5/1962 | France . |
| 2339541 | 8/1977 | France . |
| 2022063 | 12/1979 | United Kingdom . |

*Primary Examiner*—Donald F. Norton

*Attorney, Agent, or Firm*—Shapiro and Shapiro

[57] ABSTRACT

Plastic closures for beverage bottles and containers for motor oil, food, pharmaceuticals, industrial products and the like have a tamper-resistant band connected to the sidewall of the closure by internal bridges that are formed by notches in the thread core of molding apparatus of the type having mold parts, including a stripper ring, that move axially to release closures. Stretching, elongation, and weakening of bridges when the closure is stripped from the mold are avoided, and desired configuration of the bridges is maintained, with improved quality and uniformity and more consistent proper performance of the closure during application to and removal from a bottle. In a modification, a small number of relatively strong bridges is added to prevent drooping of the tamper-resistant band if some of the predominant bridges break inadvertently before removal of the closure from a bottle, for example.

15 Claims, 2 Drawing Sheets

FIG. 5
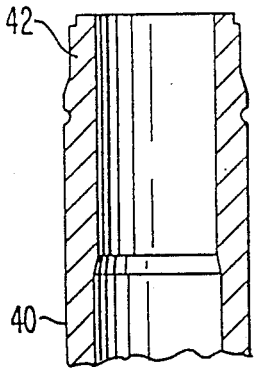
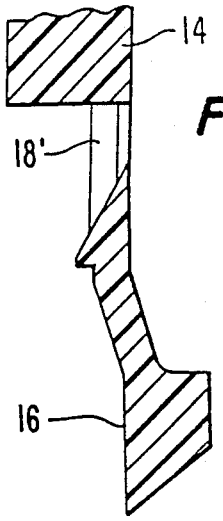
FIG. 9
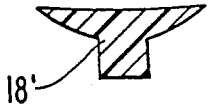
FIG. 9A
FIG. 6
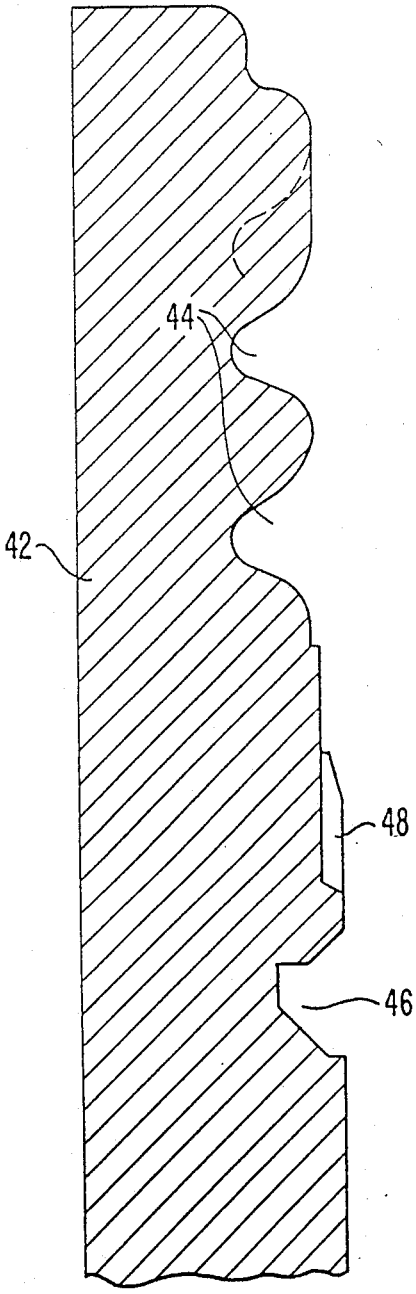
FIG. 7
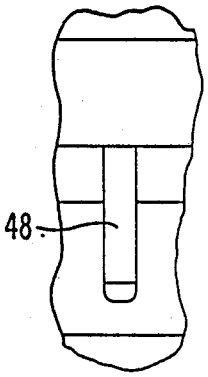
FIG. 8
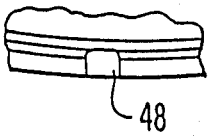

PILFER-RESISTANT PLASTIC CLOSURE

BACKGROUND OF THE INVENTION

This invention relates to plastic closures and more particularly to pilfer-resistant plastic closures of the type commonly used on beverage bottles and containers for food, pharmaceuticals, and industrial products.

The prior art of pilfer-resistant plastic closures for beverage bottles and the like has been highly developed. In general, such closures have a pilfer-resistant (tamper-resistant) band with an internal bead or internal lugs adapted to engage an annular shoulder on the neck of the bottle when the closure has been applied to the bottle. When the bottle is opened, the band breaks away (partially or entirely) from the body of the closure, so that even if the closure is reapplied to the bottle, the fact that the bottle has been opened is evident. To permit the pilfer-resistant band to break away, the closure is formed with a line of weakness or with a plurality of circumferentially spaced frangible bridges that break when the closure is removed.

Plastic closures are commonly manufactured by injection or compression molding. In one type of molding apparatus, mold parts move transversely or radially with respect to the longitudinal axis of the closure to release the closure from the mold. In another type of molding apparatus, which, in general, is simpler, mold parts move axially (along the longitudinal axis of the closure) to release the closure from the mold. The present invention is concerned with closures produced by the latter type of apparatus.

Premature breakage of the bridges that connect a tamper-resistant band to the body of a plastic closure has been a serious problem, particularly in closures that are manufactured by molding apparatus in which the closures are released from the mold by axial movement of mold parts. Such movement tends to stretch the bridges, which may cause breakage of at least some of the bridges even before the closure is applied to a bottle. Bridge breakage also occurs prematurely during closure application, when the bridges are deformed to force the internal bead of the pilfer-resistant band over the annular shoulder on the neck of the bottle.

Attempts have been made to reduce premature bridge breakage by employing more massive (stronger) bridges, but if the bridges are strong enough to prevent premature breakage, the bridges may not break at all when the closure is removed from the bottle, and the tamper-resistant band may actually stretch and be removed from the bottle when the closure is removed, without breaking the bridges. Furthermore, massive bridges require much greater force to break the bridges, and greater effort to remove the closure from the bottle.

Other attempts to solve the problem of bridge breakage during closure application do not rely on more massive bridges, but instead use thin, readily breakable bridges together with abutments that prevent collapse of the bridges and/or twisting of the bridges during application of a closure to a bottle. However, such techniques complicate the configuration of the mold and do not solve the problem of premature bridge breakage when closures are released from molding apparatus by axial movement of mold parts. One of the attempts to solve that problem, without employing unduly massive bridges, relies upon an axially moving stripper ring that engages surfaces at opposite ends of the bridges in an effort to prevent stretching of the bridges during stripping of closures from the molding apparatus. The stripper ring has notches in its internal surface for forming bridges that are located outward of the internal surfaces of the sidewall and tamper-resistant band, and for providing axial flow paths for molten plastic from the sidewall of the closure to the band. While such stripper rings assist in preventing bridge breakage during stripping of closures from the molding apparatus, it has been discovered that in volume production some of the bridges are nevertheless stretched, elongated, and weakened, causing such bridges to break prematurely. This problem occurs at random and is difficult or impossible to control.

BRIEF DESCRIPTION OF THE INVENTION

Surprisingly, it has been discovered in accordance with the present invention that the foregoing problems can be solved or substantially alleviated by molding bridges internally of the closure and its pilfer-resistant band, in bridge-forming notches provided in the external surface of the thread core of the molding apparatus. By eliminating (or minimizing) notches in the internal surface of the stripper ring, the stripper ring is able to abut evenly against the entire bottom edge of the sidewall of a closure. When the closure is stripped from the molding apparatus, there is no tendency to stretch the bridges, and the internal bridges remain true to their originally intended dimensions, that are dictated by the notches in the thread core.

The present invention employs elongated bridges that extend longitudinally for considerable distances over the internal surfaces of the closure sidewall and tamper-resistant band. The bridges are configured so that they are strong enough to minimize premature breakage and yet weak enough to permit easy breakage of the bridges when the closure is removed from the bottle.

Internal bridges per se are not unique to the present invention. However, internal bridges were not formed previously in the manner of the present invention. For the most part, prior art internal bridges (as well as some other types of bridges) require a high cost secondary cutting operation to form or weaken the bridges and to define the pilfer-resistant band after molding of the closure. By providing bridge-forming notches in the thread core, in accordance with the present invention, bridges having the desired characteristics can be made very uniformly and consistently, without a cutting operation.

In some instances, it has been found desirable to provide a few bridges that are stronger, i.e., of larger cross-sectional area, than the predominating, more easily broken bridges of smaller cross-sectional area provided in accordance with the invention. The larger bridges serve as a safeguard to prevent "drooping" of the tamper-resistant band which may occur if some of the smaller bridges are inadvertently broken during closure application. Although such drooping is not prevalent in the absence of the larger bridges, it may occur occasionally due to peculiarities of the closure application apparatus. Since the number of the larger bridges is kept quite small, separation of the body of the closure from the pilfer-resistant band is still easily accomplished when the closure is removed.

In accordance with one of its broader aspects, the invention provides a plastic closure comprising a top wall, a sidewall and a tamper-resistant band connected to the sidewall by a plurality of bridges, the band having an external shoulder at a first portion of the band adjacent to said bridges, having an internal bead at a second portion of the band remote from said bridges, and having a third portion connecting said first and second portions and configured to flex resiliently, each of said bridges being elongated and extending inwardly of and longitudinally along inner surfaces of said sidewall and said band.

In accordance with a modification of the invention, a small number of stronger bridges is provided between the sidewall of the closure and the tamper-resistant band.

BRIEF DESCRIPTION OF THE FIGURES OF THE DRAWING

FIG. 5 is a fragmentary longitudinal sectional view of a portion of a thread core that may be employed in producing closures of the invention;

FIG. 6 is an enlarged fragmentary longitudinal sectional view showing details of the thread core;

FIG. 7 is a fragmentary elevational view showing a bridge-forming notch of the thread core;

FIG. 8 is a fragmentary end view of the notch;

FIG. 9 is an enlarged fragmentary longitudinal sectional view of a portion of a modified closure of the invention, showing the configuration of the sidewall, tamper-resistant band, and a stronger bridge; and FIG. 9A is a transverse sectional view showing the cross-section of one of the stronger bridges.

DETAILED DESCRIPTION OF PREFERRED EMBODIMENTS

Figure 1:
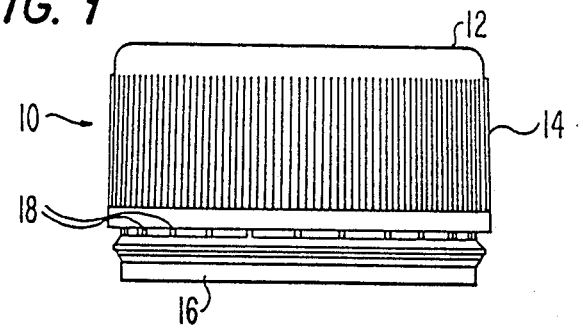
FIG. 1 is an elevational view showing a plastic closure in accordance with the invention.

As shown in FIG. 1, a plastic closure 10 in accordance with the invention (which may be molded of polypropylene or polyethylene, for example, or other suitable plastic) has a body that includes a top wall 12, a sidewall 14 (appropriately knurled as shown), and a tamper-resistant band 16 spaced from the sidewall 14 so as to form a gap G therebetween. Band 16 is connected to the sidewall 14 by a plurality (e.g., 24) of frangible bridges 18 equally spaced circumferentially of the closure. Bridges 18 bridge the gap G between the sidewall 14 and the band 16.

Figure 2:
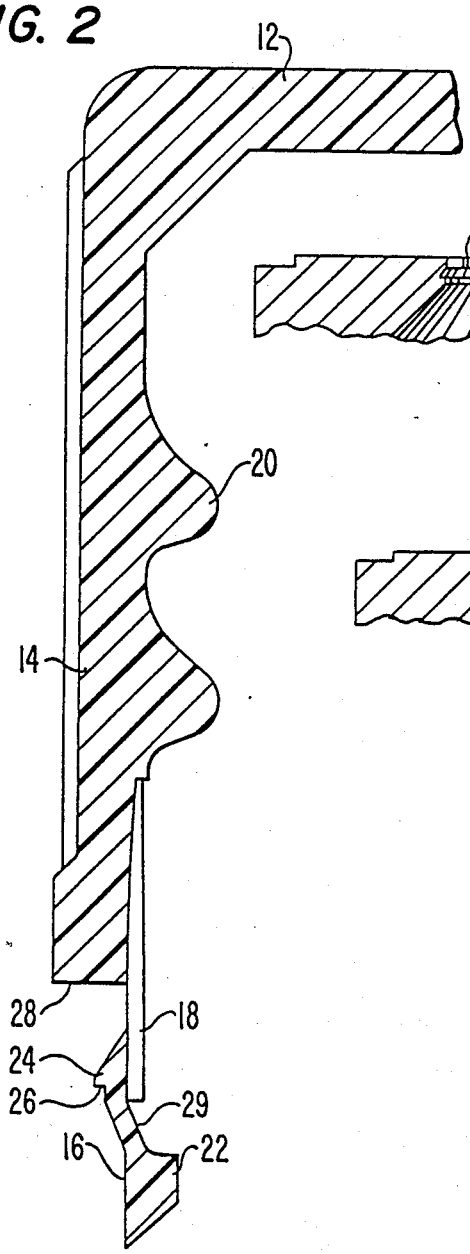
FIG. 2 is an enlarged fragmentary longitudinal sectional view of a portion of the closure, showing the configuration of the sidewall, tamper-resistant band, and bridges.

As shown in FIG. 2, the inner surface of the sidewall 14 has conventional threads 20 formed by a thread core to be described. The tamper resistant band 16 has a lower portion that includes an internal annular bead 22 that is adapted to snap over a corresponding external annular shoulder on the neck of a bottle when the closure is turned onto the bottle in a conventional and well-known manner. The lower extremity of the band 16 is tapered to facilitate the outward expansion of the band required to force the band over the shoulder on the bottle. An upper portion 24 of the band is also tapered (as shown) and has an external annular shoulder 26 spaced from the bottom edge 28 of the sidewall 14. An intermediate portion 29 of the band is elongated and is thin enough to flex resiliently when the bead 22 is forced over the annular shoulder of the bottle.

Figure 2A:
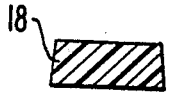
FIG. 2A is a transverse sectional view showing the cross-section of one of the bridges.

The bridges 18 are located inwardly of adjacent inner surfaces of the sidewall 14 and the band 16. Each bridge is elongated and extends for a considerable distance over the inner surfaces of the sidewall and the band as shown. Each bridge is preferably tapered and has a cross-section at a lower, band end of the bridge that is greater than the cross-section at an upper, sidewall end of the bridge. A typical bridge cross-section just below the bottom edge 28 of the sidewall is illustrated in FIG. 2A. At that point each bridge is typically 0.018 inch wide (circumferentially of the closure at the inner surface of the bridge), and 0.0075 inch thick (radially of the closure). Typically, each bridge has a length of 0.208 inch and a taper of 3 degrees from top to bottom in radial planes. Also, each side edge of the bridge (the edges that are spaced circumferentially of the closure) has a 5 degree taper so that the outer surface of each bridge is slightly wider circumferentially than the inner surface. The bridge configuration avoids significant reduction of the effective inner diameter of the lower portion of the sidewall, provides sufficient strength to minimize premature bridge breakage, and yet assures that the bridge will break properly when a closure is removed from a bottle.

Figure 3:
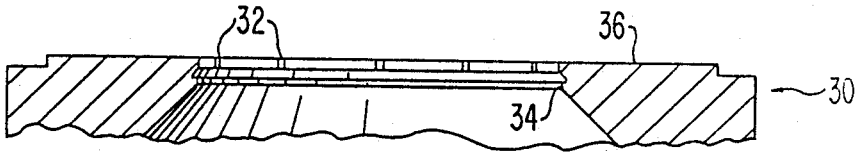
FIG. 3 (PRIOR ART)
FIG. 3 is a fragmentary longitudinal sectional view showing a portion of a stripper ring of the prior art.

FIG. 3 illustrates a portion of a prior art stripper ring 30 employed for forming a sidewall bottom edge, upper portion of a tamper-resistant band, and bridges of a prior art plastic closure. The bridges of the prior art closure are formed by notches 32 in the internal surface at one end of the stripper ring, and are located externally of the inner surfaces of the sidewall and the tamper-resistant band, i.e., between the bottom edge of the sidewall and the upper portion of the band. The stripper ring 30 is provided with an internal shoulder 34 that forms an external shoulder of a tamper-resistant band of the prior art. Although the stripper ring 30 has an upper surface 36 that engages the bottom edge of the prior art closure while the shoulder 34 of the stripper ring engages the shoulder of the tamper-resistant band, so that axial stripping forces are applied to surfaces at both ends of the prior art bridges during stripping of the prior art closures from injection molding apparatus, it has been found that in volume production some of the bridges are nevertheless stretched and weakened by the stripping operation, in a random and uncontrollable manner. Accordingly, when closures formed in this manner are applied to bottles, some of the bridges tend to break prematurely, when the closure is applied, rather than when the closure is removed from the bottle.

Figure 4:
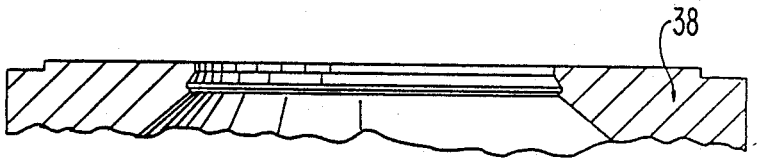
FIG. 4 is a similar view showing a portion of a stripper ring that may be employed in producing closures of the invention.

In accordance with the present invention, bridges are formed inwardly of the inner surfaces of the sidewall and tamper-resistant band of the closure, by notches in the thread core of the molding apparatus, rather than by notches in the stripper ring. As shown in FIG. 4, a stripper ring 38 employed in producing closures of the invention has essentially the same configuration as the stripper ring 30 of the prior art, except that the circular opening or bore at the upper end of the stripper ring is smooth, since there are no notches.

FIGS. 5–8 illustrate portions of a thread core 40 employed in producing closures of the invention. The upper portion 42 of the thread core is shown in detail in FIG. 6. As shown, the external surface of the thread core is provided with threads 44 for forming the threads 20 of the closure. Below the threads 44 the thread core has a circumferential groove 46 configured to cooperate with the stripper ring in forming the tamper-resistant band 16.

Unlike the thread core employed in prior art molding apparatus in conjunction with the prior art stripper ring 30, the external surface of the thread core 40 is provided with a plurality of longitudinal notches 48 for forming the bridges 18, the configuration of the notches being evident from FIGS. 6–8. The external surface of the bridges between the bottom edge 28 of the sidewall of the closure and the upper portion 24 of the tamper-resistant band is defined by the smooth bore of the stripper ring 38, which surrounds the thread core.

The general arrangement of injection molding apparatus that may be employed in the invention and its mode of operation are well known in the art and require no detailed description. See, for example, published U.K. patent application No. GB 2022063A (published Dec. 12, 1979). The stripper ring 38 and the thread core 40 move longitudinally relative to a fixed core (that defines an external surface of the tamper-resistant band) when the closure is stripped from the molding apparatus, after longitudinal movement of mold parts (which form the outer surfaces of the top wall and sidewall of the closure) to prepare the closure for release from the molding apparatus. Ultimately, an ejector pin moves longitudinally through a fixed core part (that forms most of the internal surface of the top wall of the closure) to eject the finished closure from the molding apparatus.

By virtue of the invention, the random, uncontrollable stretching and weakening of bridges during stripping of plastic closures from molding apparatus are prevented. The bridges of the present invention are precisely, uniformly, and consistently formed with the desired configuration and they are much more resistant to premature breakage. Nevertheless, the bridges of the invention break readily when a closure is removed from the bottle.

While plastic closures constructed and produced as set forth in the foregoing description perform well in most instances, on occasion a few of the bridges 18 may break prematurely (usually during application of a closure, due to peculiarities of the application apparatus), allowing the pilfer-resistant band to hang down or "droop" away from the body of the closure. It has been found that such an occurrence can be prevented by providing a small number of larger bridges that are more resistant to breakage, so that if a few of the smaller bridges break prematurely, the larger bridges hold up the pilfer-resistant band and prevent drooping.

For example, four, equally-spaced larger bridges may be provided together with twenty of the smaller bridges formed as set forth in the foregoing description. The four larger bridges may replace four smaller bridges, so that each pair of circumferentially successive larger bridges embraces five equally spaced smaller bridges therebetween. The larger bridges may be formed either internally or externally of the inner surface of the sidewall of the closure, i.e., they may be formed by notches in the thread core or in the stripper ring. In the latter case, since the number of notches in the stripper ring is so small, the improved operation of the stripper ring described earlier is not significantly degraded. The larger notches also serve to improve the flow of thermoplastic material to the tamper-resistant band during manufacture.

FIGS. 9 and 9A illustrate the larger bridges 18' employed in accordance with this modification of the invention. In the example shown, the larger bridges 18' are formed external to the inner surfaces of the sidewall 14 and the band 16 and are therefore formed by corresponding notches in the stripper ring. As shown, each of the larger bridges has a larger cross-sectional area than each of the smaller bridges, at least in the region of gap G between the lower edge of the sidewall and the top surface of the tamper-resistant band, between which each of the larger bridges extends. As shown in FIG. 9A, the cross-section of each larger bridge may be somewhat T-shaped. The stem of the T may have a circumferential width of 0.012 inch. The radial dimension of the bridge may be 0.015 inch, with the radial dimension of the cap of the T being 0.006 inch. The radially innermost surface of the T (closest to the axis of the closure) may have a slight curvature (parallel to the curvature of the sidewall of the closure) in a plane perpendicular to the axis of the closure, and the radially outermost surfaces of the cap of the T may have a radius of 0.024 inch.

When the modified closure of the invention is applied to a bottle, for example, even if some of the smaller bridges are inadvertently broken, the pilfer-resistant band cannot droop. As the closure is turned off (unthreaded) from the bottle, the smaller bridges are readily broken. The pilfer-resistant band then hangs up on the shoulder of the neck of the bottle or becomes stuck on the thread. In either case, as the closure threads are disengaged from the threads of the bottle, any of the larger bridges that are still intact are broken, to retain the pilfer-resistant band on the bottle. The provision of the larger bridges also tends to prevent the closure from releasing prematurely from the bottle if the contents are pressurized. Although, as noted earlier, closures are known in which rather massive bridges are employed to connect the body of the closure to a tamper-resistant band, such bridges have not been provided in a closure like that of the present invention, in which smaller, weaker, predominant bridges are disposed internally of the sidewall of the closure and the tamper-resistant band.

While preferred embodiments of the invention have been shown and described, it will be apparent to those skilled in the art that changes can be made in these embodiments without departing from the principles and spirit of the invention, the scope of which is defined in the appended claims.

The invention claimed is:

1. A plastic closure comprising a top wall, a sidewall, and a tamper-resistant band, said band being connected to said side wall by a plurality of elongated bridges that extend inwardly from and longitudinally along internal surfaces of said sidewall and said band, each of said bridges being tapered along its length and increasing in cross-section from a side wall end of the bridge to a band end of the bridge.

2. A plastic closure in accordance with claim 1, wherein said sidewall has internal threads formed thereon.

3. A plastic closure in accordance with claim 2, wherein the sidewall of the closure is spaced from the tamper-resistant band to form a gap therebetween, and the band has an external shoulder adjacent to said bridges.

4. A plastic closure in accordance with claim 1, wherein said band is also connected to said sidewall by additional bridges substantially fewer than said plurality of bridges, each of said additional bridges having a cross-section substantially larger than the cross-section of each of said plurality of bridges at a region of said closure between said sidewall and said band.

5. A plastic closure in accordance with claim 4, wherein said additional bridges are substantially equally spaced around the periphery of said sidewall and said band, with each pair of successive additional bridges embracing a group of said plurality of bridges therebetween.

6. A plastic closure in accordance with claim 5, wherein each of said additional bridges extends between a lower edge of the sidewall and a top surface of said band in a gap therebetween.

7. A plastic closure comprising a top wall, a sidewall and a tamper-resistant band connected to the sidewall by a plurality of bridges, the band having an external shoulder at a first portion of the band adjacent to said bridges, having an internal bead at a second portion of the band remote from said bridges, and having a third portion connecting said first and second portions and configured to flex resiliently, each of said bridges being elongated and extending inwardly of and longitudinally along inner surfaces of said sidewall and said band.

8. A plastic closure in accordance with claim 7, wherein each of said bridges is tapered along its length and has a cross-section that increases from a sidewall end of the bridge to a band end of the bridge.

9. A plastic closure in accordance with claim 7, wherein said band is also connected to said sidewall by additional bridges substantially fewer than said plurality of bridges, each of said additional bridges having a cross-section substantially larger than the cross-section of each of said plurality of bridges at a region of said closure between said sidewall and said band.

10. A plastic closure in accordance with claim 9, wherein said additional bridges are substantially equally spaced around the periphery of said sidewall and said band, with each pair of successive additional bridges embracing a group of said plurality of bridges therebetween.

11. A plastic closure in accordance with claim 10, wherein each of said additional bridges extends between a lower edge of the sidewall and a top surface of said band in a gap therebetween.

12. A one-piece molded plastic closure comprising a top wall, a sidewall, and a tamper-resistant band, said band being spaced from said sidewall to form a gap therebetween, said gap being bridged by a plurality of elongated bridges that extend inwardly from and longitudinally along internal surfaces of said sidewall and said band, said band having an external shoulder at a first portion of the band adjacent to said bridges, having an internal bead at a second portion of the band remote from said bridges, and having a third portion connecting said first and second portions and configured to flex resiliently.

13. A one-piece molded plastic closure in accordance with claim 12, wherein said gap is also bridged by additional bridges substantially fewer than said plurality of bridges, each of said additional bridges being constructed to provide greater resistance to breakage than each of said plurality of bridges.

14. A one-piece molded plastic closure in accordance with claim 13, wherein each of said additional bridges is disposed in said gap.

15. A one-piece molded plastic closure in accordance with claim 13, wherein said additional bridges are substantially equally spaced around the periphery of said sidewall and said band, with each pair of successive additional bridges embracing a group of said plurality of bridges therebetween.

* * * * *